US009486375B2

(12) United States Patent
Vladeta

(10) Patent No.: US 9,486,375 B2
(45) Date of Patent: Nov. 8, 2016

(54) BACK SUPPORT DEVICE

(71) Applicant: Daniel Vladeta, Tamarama (AU)

(72) Inventor: Daniel Vladeta, Tamarama (AU)

( * ) Notice: Subject to any disclaimer, the term of this patent is extended or adjusted under 35 U.S.C. 154(b) by 73 days.

(21) Appl. No.: 14/073,426

(22) Filed: Nov. 6, 2013

(65) Prior Publication Data

US 2014/0090174 A1 Apr. 3, 2014

Related U.S. Application Data

(62) Division of application No. 12/520,720, filed as application No. PCT/AU2007/002007 on Dec. 24, 2007, now abandoned.

(30) Foreign Application Priority Data

Dec. 22, 2006 (AU) ..... 2006907160

(51) Int. Cl.

| | |
|---|---|
| ***A47G 7/07*** | (2006.01) |
| ***A61G 7/07*** | (2006.01) |
| ***A47C 7/42*** | (2006.01) |
| ***A47C 20/02*** | (2006.01) |
| ***A47C 7/40*** | (2006.01) |

(52) U.S. Cl.
CPC . *A61G 7/07* (2013.01); *A47C 7/40* (2013.01); *A47C 7/425* (2013.01); *A47C 20/027* (2013.01)

(58) Field of Classification Search
CPC ..... A47C 7/07
USPC ..... 5/632–633, 636, 630
See application file for complete search history.

(56) References Cited

U.S. PATENT DOCUMENTS

| | | | | |
|---|---|---|---|---|
| 4,696,516 | A | 9/1987 | Yeum | |
| 4,810,034 | A | 3/1989 | Beier | |
| 6,969,114 | B2 | 11/2005 | Keilhauer | |
| 2003/0227201 | A1 * | 12/2003 | Keilhauer | A47C 7/425 297/230.1 |
| 2005/0207609 | A1 * | 9/2005 | Oser | A47C 7/72 381/396 |

FOREIGN PATENT DOCUMENTS

| | | |
|---|---|---|
| JP | 08010470 | 1/1996 |

* cited by examiner

*Primary Examiner* — Fredrick Conley
(74) *Attorney, Agent, or Firm* — Gordon & Jacobson, P.C.

(57) ABSTRACT

A back support device (100) having a first convex region (160) and a concave region (200) being connected to the first convex region (160), the first convex region (160) and the concave region (200) being configured to support respective regions of a user's back, wherein a ratio between a straight line distance across the first convex region (160) and a straight line distance across the concave region (200) approximates a geometric progression.

18 Claims, 22 Drawing Sheets

A

B

BACK SUPPORT DEVICE

CROSS-REFERENCE TO RELATED APPLICATIONS

This application is a divisional of U.S. Ser. No. 12/520,720, filed Dec. 3, 2009, which claims priority from PCT/AU2007/002007, filed on Dec. 24, 2007, which are hereby incorporated by reference herein in their entireties.

FIELD OF THE INVENTION

The present invention relates to personal support devices and in particular to back support devices. The back support devices can include but not limited to chairs, sofas, beds, or the like.

DESCRIPTION OF THE BACKGROUND ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Back pain is second only to the common cold as a health problem suffered by people. In the USA, over 5 million people suffer acute back problems. Back problems may be caused for example by poor posture, poor sleeping positions and poor seated positions. Relief and preventative treatment of back problems is desired by the community at large. Common active treatment techniques include those practiced by physical therapists, osteopaths, chiropractors, and masseurs. Passive techniques include learning correct posture, and the use of back support devices, such as back rolls. Back rolls are typically in the form of a cylindrical cushion which is placed at the bottom of the back rest portion of a chair. Such passive techniques provide only limited relief to sufferers of back pain.

SUMMARY OF THE PRESENT INVENTION

The present invention seeks to substantially overcome, or at least ameliorate, one or more disadvantages of existing arrangements.

It will be appreciated that the broad forms of the invention may be used individually or in combination.

According to a first broad form, there is provided a back support device having a first convex region and a concave region being connected to the first convex region, the first convex region and the concave region being configured to support respective regions of a user's back, wherein a ratio between a straight line distance across the first convex region and a straight line distance across the concave region approximates a geometric progression.

In one example, the back support device has a second convex region, the second convex region being connected to the concave region such that the concave region is formed between the first convex region and the second convex region.

In a further example, a ratio between a straight line distance across the second convex region and the straight line distance across the concave region approximates the geometric progression.

According to another aspect, the first convex region, the second convex region, and the concave region are portions of respective circles having radii, the ratio between the radii of the respective circles approximate to the geometric progression.

In a further example, the geometric progression is a Fibonacci sequence.

According to another example, the geometric progression approximates to 1.6±0.1.

In yet another example, the geometric progression approximates to 1.62±0.05.

In a further form, the first convex region is configured to support a portion of a lumbar region of the user's back, the second convex region is configured to support a portion of a cervical region of the user's back, and the concave region is configured to support a portion of a thoracic region of a user's back.

In accordance with another aspect, the device has a curved rear surface, such that the device is movable in a rocking motion on a ground surface.

In yet another example, the device is resiliently deformable.

In a further aspect, the device includes a first segment and a second segment, the first segment including the first convex region and the second segment including the concave region, wherein any one or a combination of the first segment and the second segment are moveable in respect of each other.

According to another aspect, the first segment and second segment are moveable such that the back support device is able to support different spinal lengths.

In a further example, when in a position that represents a maximum spinal length, the device is resiliently deformable in use, such that the ratio of the straight line distance across the first convex region and the concave region is maintained approximately to the geometric progression.

According to another example, the first convex region and the concave region are portions of respective circles having radii, the ratio between the radii of the respective circles approximate to the geometric progression.

In yet a further example, the second segment is configured to slide upon a concave arcuate sliding surface, of a third segment of the device, away from the first segment, the first segment being supported on a concave supporting surface of the device, the sliding surface having a diameter substantially similar to the diameter of the first convex region.

According to another aspect, the third segment of the device has a curved rear surface, the curved rear surface, the concave sliding surface, and the concave supporting surface being portions of respective circles having radii, the ration between the radii of the respective circles approximating to the geometric progression.

In accordance with another form, the third segment of the device has a curved rear surface, the ratio between the straight line distance across the curved rear surface, the concave supporting surface, and the concave sliding surface approximating to the geometric progression.

In accordance with another aspect, the first convex region and the concave region form a support surface, the support surface being any one or a combination of:

at least partially laterally flat;

at least partially laterally convex; and, at least partially laterally concave.

In another example, a lateral edge of the support device is rounded.

In yet another example, the device has varying transversal width along the device.

According to a further example, the narrowest portion of the device is configured to sit between the user's shoulder blades along a portion of the user's thoracic region.

According to another aspect, the device includes any one or a combination of:

a head support portion; and, a seat portion.

In a further example, the head support portion and the seat portion are formed such that ratio between the straight line distances across respective curves of the head support portion and the seat portion and the straight line distances of the first convex region and the concave region of the device approximate to the geometric progression.

According to another form, the device is formed at least partially of any one or a combination of:

a rigid material; and, a dynamic material.

In respect of another example, the device forms a part of any one or a combination of:

a chair;

a seat;

a sofa; and, a bed.

In yet another example, the device supports a user's spine such that when a predetermined pressure is applied by the device to the spine, at least some adjacent pairs of vertebra of the spine are held in tension.

According to yet another aspect, a portion of the device is configured to be manipulated by any one or a combination of:

a heating means;

electrical stimulation; and, infra red light.

According to another example, the device is configured to flex and extend in use.

In a further example, the device is configured to be used in any one or a combination of positions, including:

a vertical position;

a horizontal position; and, at a position between the vertical position and the horizontal position.

In a further example, a portion of the device is able to vibrate.

In accordance with another aspect, the device includes a longitudinal channel, the channel being configured to receive a user's spinous process'.

According to a second broad form, there is provided a back support device having a first convex region, a second convex region, and a concave region, the concave region being formed between the first convex region and the second convex region, wherein each convex and concave region is configured to support a respective region of a user's back.

According to a third broad form, there is provided back support device having a first convex region and a concave region connected to the convex region, the first convex region and the concave region being configured to support respective regions of a user's back, wherein the first convex region, and the concave region are portions of respective circles having radii, and the ratio between the radii of the respective circles approximate to a geometric progression.

According to a fourth broad aspect, there is provided a back support device comprising a support surface having first and second convex support regions and a third concave support region between the first and second support regions arranged such that the first, third and second support regions are configured end to end in series, wherein each of the support regions is configured to support a different section of a user's back.

The form of the device is arranged such that, when in use, at least some of the connections between the user's vertebrae are placed in relative tension, providing at least some relief from certain forms of back pain.

In a further example, the longitudinal dimension of the device, a distance along the first region is greater than a distance along each of the second and third regions and the distance along the second region is less than the distance along each of the first and third regions.

In another example, each of the first, second and third regions are arcuate. The arcuate regions may be defined by respective radii, and the radius of the first, third and second regions may decrease in turn by a geometrical progression. The ratio between the radii of the first and third regions and/or the third and second regions may be Fibonacci ratios.

The Fibonacci numerical sequence is derived by starting with 0 and 1, then adding the previous two numbers in the sequence to arrive at the next number in the sequence. This is illustrated by the sequence:

0, 1, 1, 2, 3, 5, 8, 13, 21, 34, 55, 89, 144, 233, . . .

A Fibonacci ratio is any ratio between a number and the number immediately to its left in the Fibonacci sequence, typically beginning from the number 5 in the sequence. As the sequence increases, the ratio of one number in the sequence to the number immediately to its left approximates what is known as the golden ratio, typically denoted by the Greek letter (its inverse is typically denoted by the Greek letter Φ, also referred to herein as Phi). The golden ratio is defined by the equation:

$$\Phi = \frac{1+\sqrt{5}}{2}$$

It is also the ratio that results when a line is divided so that the whole line has the same ratio to the larger divided line segment as the larger divided line segment has to the smaller divided line segment. The golden ratio, adjacent numerical pairs from the above sequence and strings of numbers from the above sequence have been observed in several biological settings, such as the arrangement of the seeds in a pinecone, the spirals of the florets of a sunflower and also with respect to the human body. For example, the ratio of the length of the forearm to the length of the hand from tip of the middle finger to wrist approximates the golden ratio.

Furthermore, the inventor has noted that with regard to a normal spine, the ratio of the radius of the cervical section of the spine to the radius of the thoracic section of the spine, and the ratio of the radius of the thoracic section of the spine to the radius of the lumber section of the spine each also approximate the golden ratio. The inventor has found that the use of Fibonacci ratios between the different regions of the device, aside from providing a pleasing aesthetic, can complement the normal curvature of the spine to provide a relaxing and therapeutic affect. Also, the shape may help a user whose spine's curvature does not follow Fibonacci ratios to attain such a curvature to help improve their posture.

In another example, the ratio between the radii of the first and third regions and/or the third and second regions is 1.6±0.1. Further optionally, the ratio between the radii of the first and third regions and/or the third and second regions is 1.62±0.05.

According to another aspect, the ratio between the first straight line distance between opposite ends of the first support region and a second straight line distance between opposite ends of the third support region, and/or between the second straight line distance and a third straight line distance between opposite ends of the second region are Fibonacci ratios. Further optionally, the ratio between the first straight line distance and the second straight line distance and/or between the second straight line distance and the third straight line distance is 1.6±0.1. Also further optionally, the ratio between the first straight line distance and the second straight line distance and/or between the second straight line distance and the third straight line distance is 1.62±0.05. Optionally, the first and third support regions meet at a first point and the third and second support regions meet at a second point.

In a further example, the first region is configured to support at least some of the lumber region of the user's spine, and/or the second region is configured to support at least some of the cervical region of the user's spine and/or the third region is configured to support at least some of the thoracic region of the user's spine. Optionally, the first region is configured to support at least some of the pelvic region of the user's spine and/or the second region is configured to support at least some of the user's neck.

The back support device may comprise a curve rear surface, opposite the support surface, such that the device is movable in a rocking motion on a ground surface.

The device may be resiliently deformable.

In yet another example, the device comprises a first part and a second part, wherein the first part comprises the first support region and the second part comprises the second support region, and wherein the second part is movable with respect to the first part between first and second positions, and the distance between the first and second regions is greater in the second position compared to when in the first position.

According to another aspect, the first and second parts are slidably connected to each other. Optionally, the first part comprises a concave arcuate sliding surface for the second part to slide thereupon, the sliding surface having a diameter substantially similar to the diameter of the first support region. Further optionally, the first part comprises a first portion and a second portion, the first portion comprising the first support region and the second portion comprising at least some of the sliding surface. The first portion may be less deformable than the second portion. The first portion may be joined to the second portion along a curved border. The second portion may comprise a rear curved surface. Optionally, the rear curved surface is opposite the curved border. Optionally, the rear curved surface and the curved border are arcuate, and the ratio between the radii of the rear surface in use and the border is a Fibonacci ratio. Further optionally, the ratio between a fifth straight line distance and a fourth straight line distance is a Fibonacci ratio, where the fourth straight line distance is defined between an end of the device at the first support region and at a point where the second and third support regions meet, and the fifth straight line distance is defined between opposite ends of the device. Further optionally, the ratio between the radii of the rear surface in use and the border and/or the fifth and fourth straight line distances is 1.6±0.1. Further optionally, the ratio between the radii of the rear surface in use and the border and/or the fifth and fourth straight line distances is 1.62±0.05.

The support surface may be laterally flat or laterally convex or laterally concave or another suitable surface. A lateral edge of the support surface may be rounded.

In yet a further example, the support surface is arranged to support and contact a user's spine, such that when a predetermined pressure is applied by the device to the spine, at least some adjacent pairs of vertebra of the spine are held in tension. Also optionally, the support surface may be arranged to receive the user's spine when the user is in a face up prostate position.

According to another aspect of the present invention there is provided a back support device comprising a support surface having first and second convex support regions and a third concave support region between the first and second support regions arranged such that the first, third and second support regions are configured end to end in series, wherein each of the support regions is configured such that when a predetermined pressure is applied by the device to the spine, at least some adjacent pairs of vertebra of the spine are held in tension.

In a further example, the support regions are arcuate and defined by respective radii, and the radius of the first, third and second regions decrease in turn by a geometrical progression. Optionally, the ratio between the radii of the first and third regions and/or the third and second regions are Fibonacci ratios. Further optionally, the ratio between the radii of the first and third regions and/or the third and second regions is 1.6±0.1. Also further optionally, the ratio between the radii of the first and third regions and/or the third and second regions is 1.62±0.05.

BRIEF DESCRIPTION OF THE DRAWINGS

Preferred embodiments of the invention will now be described, by way of example only, with reference to the accompanying drawings in which.

DETAILED DESCRIPTION INCLUDING BEST MODE

A back support device having a first convex region and a concave region attached to the convex region is described below.

Figure 1:
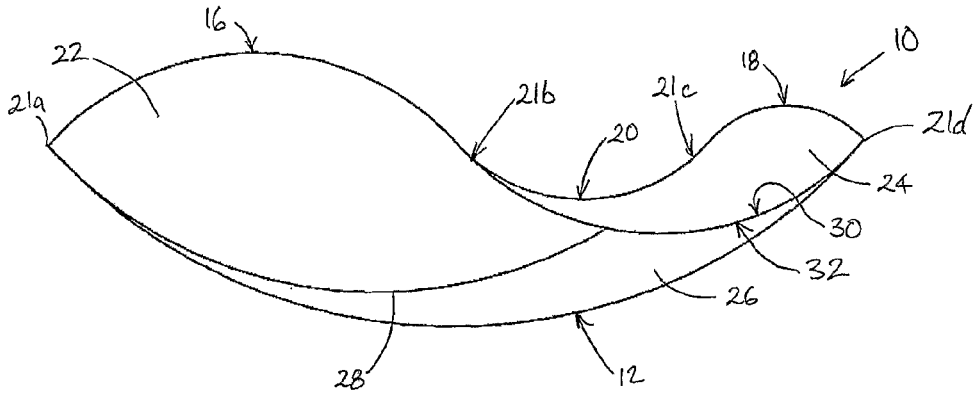
FIG. 1 illustrates a side elevation of an example of a back support device.
Figure 2:
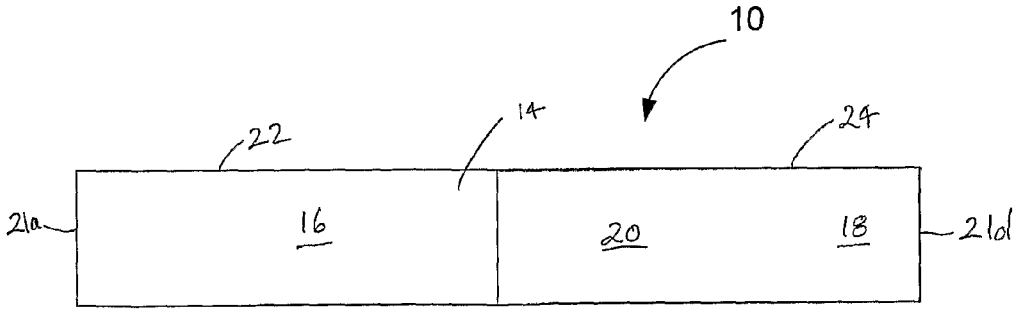
FIG. 2 illustrates a plan view of the example device illustrated in FIG. 1.

In particular, FIGS. 1 and 2, show an example of a back support device 10 having a rear surface 12 configured to be placed upon a ground surface. The device 10 has a support surface in the form of a back support surface 14 comprised of first and second convex support regions 16 and 18 and a third concave support region 20 between the first and second support regions 16, 18. Each of the first, second and third support regions 16, 18, 20 are arcuate and in this embodiment, each of the regions 16, 18, 20 trace an arc of about 99°.

In one dimension of the device 10, for example from left to right of the device illustrated in FIGS. 1 and 2 where the first, third and second regions 16, 20, 18 are configured end to end in series, a first straight distance along the first region 16 from an end 21*a* of the device 10 to a first point 21*b* with the third region 20 is greater than a second straight line distance along the third region 20 from the first point 21*b* to a second point 21*c* with the second region 18, and is greater than a third straight line distance along the second region 18 from the second point 21*c* to another end 21*d* of the device 10. Also, the second straight line distance is greater than the third straight line distance. The ratio between the radii of the first and third regions 16, 20 and between the third and second regions 20, 18 are Fibonacci ratios approximating the above mentioned golden ratio. Also, the ratios between the first and second straight line distances, and between the second and third straight line distances are Fibonacci ratios approximating the golden ratio.

The configuration of the first, third and second support regions 16, 20, 18 approximates the curvature of the human spine. In this regard, the first support region 16 is configured to complement the curvature of the lumber and pelvic region of a spine, the third region 20 is configured to complement the curvature of the thoracic region of a spine and the second region 18 is configured to complement the curvature of the cervical region of the spine. The curvature of the human spine follows an undulating path of concave (cervical), convex (thoracic) and concave (lumbar/pelvic). In a typical human spine, the ratio of radius of the lumbar/pelvic region to the thoracic region and of the thoracic region to the cervical region each approximate the above described golden ratio. Therefore, given the golden ratios of radii from first 16 to third 20 and from third 20 to second 18 regions approximate the golden ratio, the overall support surface 14 complements the curvature of the typical human spine. The overall longitudinal length of the device 10 is configured to approximate the length of the human spine, which for the majority of adults falls within the range of 55 to 63 cm.

Figure 3:
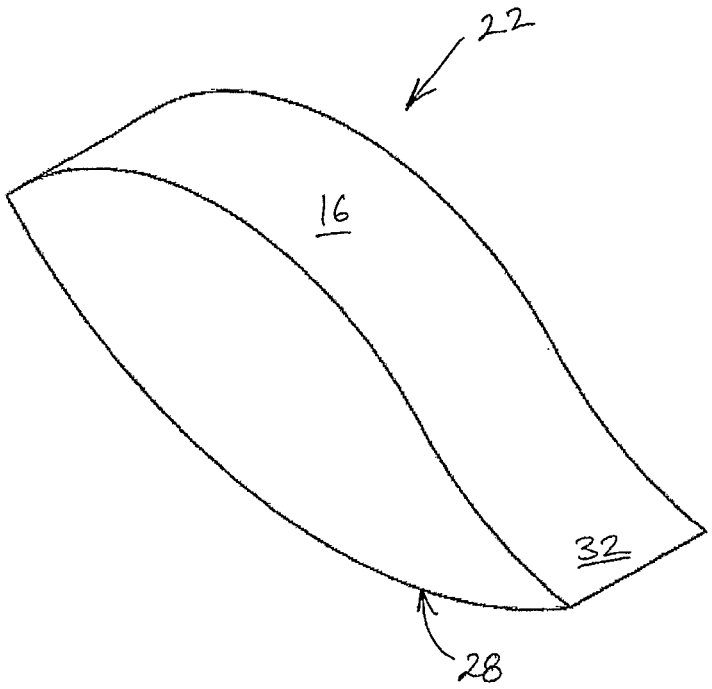
FIGS. 3 to 5 illustrate side elevations of segments which can be combined to form the example device illustrated in FIG. 1.
Figure 4:
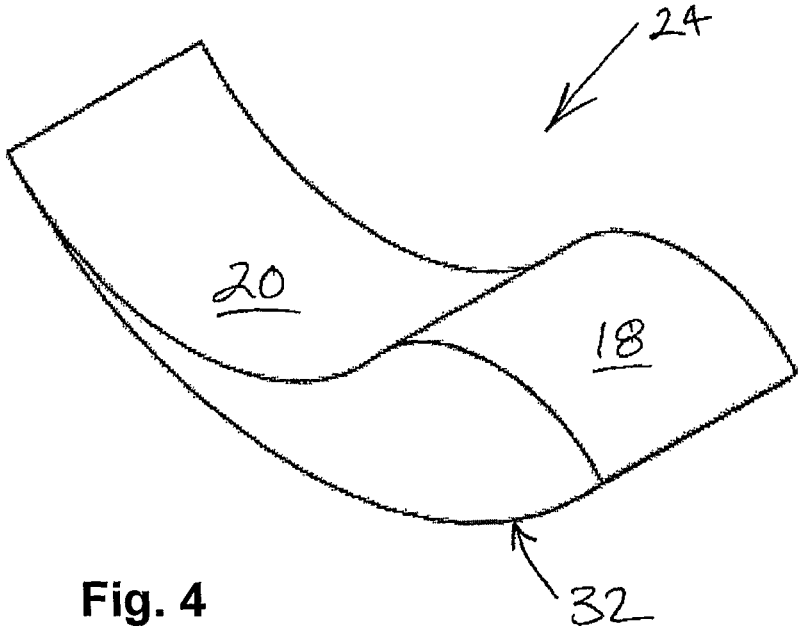
Figure 5:
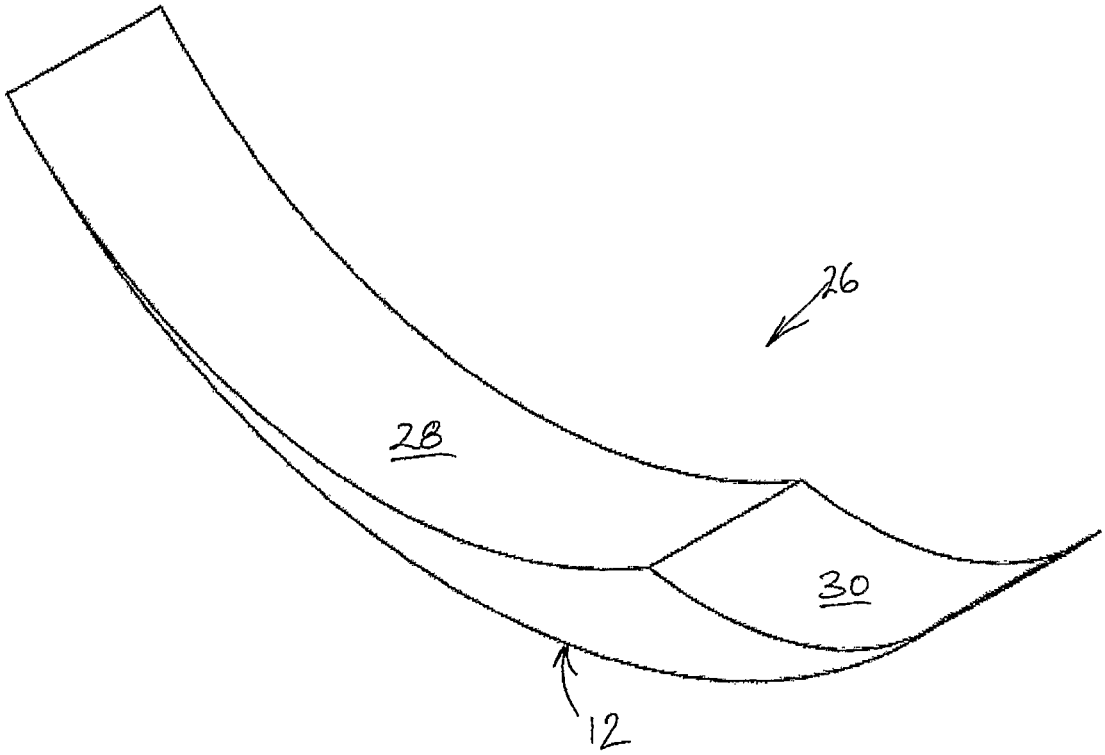

The device 10 of this embodiment is formed from three segments. The first segment 22, illustrated in FIG. 3, comprises the first support region 16. The second segment 24, illustrated in FIG. 4, comprises the second and third support regions 18, 20. The third segment 26, illustrated in FIG. 5, comprises the rear surface 12. The first, second and third segments 22, 24, 26 are assembled to form the device 10 illustrated in FIGS. 1 and 2.

Figure 6:
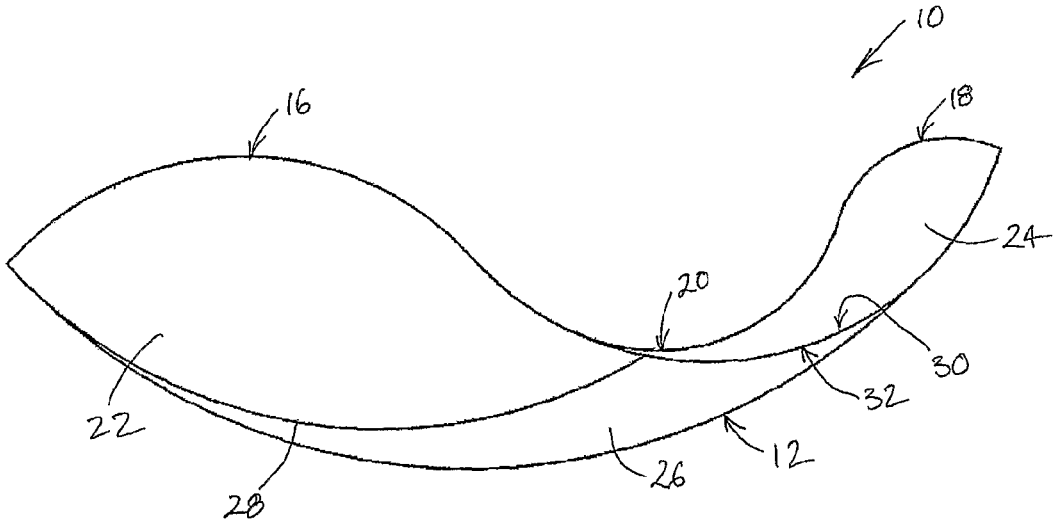
FIG. 6 illustrates a side elevation of the example device illustrated in FIG. 1 in a second position.

The first and third segments 22, 26 are fixed together on join surface 28, and form a continuous sliding surface 30. Sliding surface 30 has the same radius as first surface 16, and the ratio of the radius of join surface 28 to sliding surface 30 (and the first surface 16) approximates the golden ratio. Also, if the curve of the join surface is continued through the second segment it crosses the support surface 14 at the second point 21*c*. The ratio between a fourth straight distance between end 21*a* and second point 21*c* and the third straight distance is a Fibonacci ratio, approximating the golden ratio. A surface 32 of the second segment 24, opposite the second region 18, is complementary to and configured for slidable movement between first and second positions on the sliding surface 30. The device 10 is illustrated in FIG. 1 in the first position and can move out to the second position, illustrated in FIG. 6 by sliding along the sliding surface 30. This allows the device 10 to accommodate users having different spinal lengths. The second segment 24 is slidably engaged with the sliding surface 30 by way of a rail and groove arrangement. As will be appreciated, any appropriate mechanism which allows the slidable movement of the second segment 24 on the sliding surface 30 may be used.

It is preferred, although not essential, that the third segment 26 is formed from a relatively firmer ethylene vinyl acetate (EVA) foam material compared with the EVA material from which the first and second segments 22, 24 are formed. The foam density of the first and second segments 22, 24 in this embodiment is between 10 and 15, however in alternative embodiments may be between 10-30 or 5-60. The foam density of the third segment 26 in this embodiment is about 200, however in alternative embodiments may be between 10-200, 10-400, or 60-80. In alternative embodiments, other appropriate materials may be used.

Figure 7:
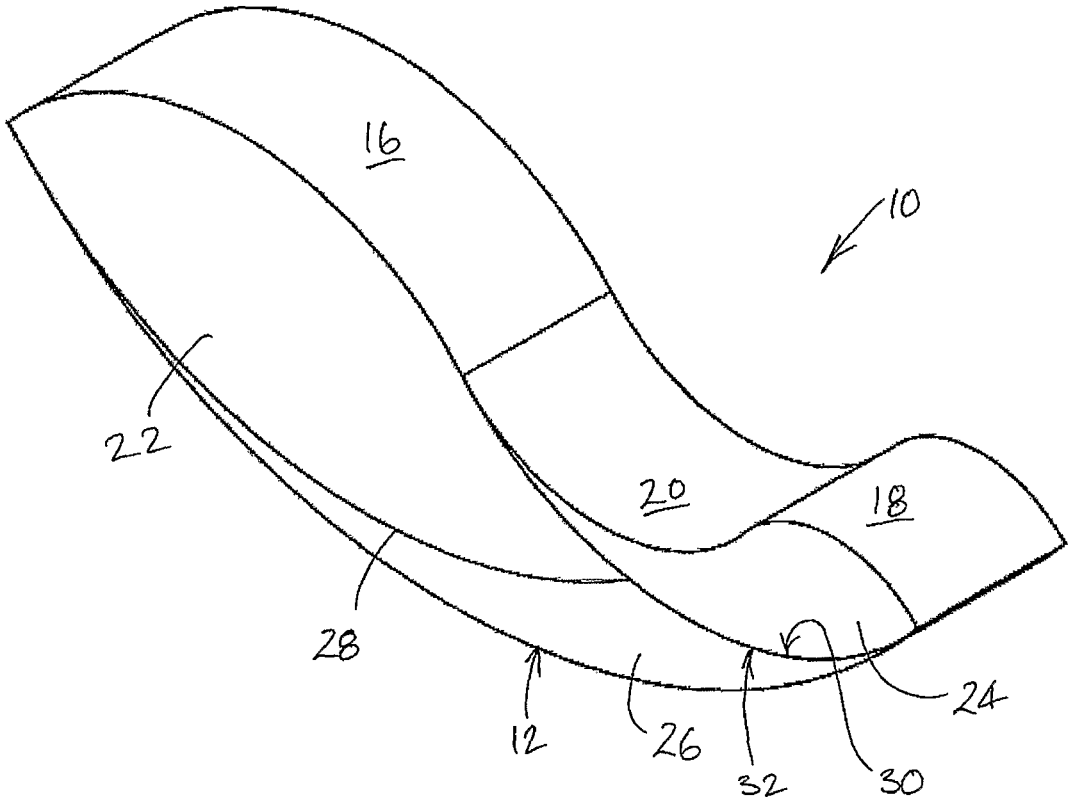
FIG. 7 illustrates a perspective view of the example device illustrated in FIG. 1.

As illustrated in FIG. 7, the first, second and third regions 16, 18, 20 are laterally flat. In an alternative embodiment, the first, second and third regions 16, 18, 20 have a longitudinal gulley/channel, to accommodate/receive the user's spine and to prevent the user from slipping or rolling off the device 10. An example device showing a channel is further described below.

In another alternative embodiment, the first, second and third regions 16, 18, 20 may be laterally convex. The device 10 is illustrated in FIG. 7 as having a constant lateral width along its longitudinal length. In an alternative embodiment, the first region 16 is wider than the third region 20, which is in turn wider that the second region 18. This change in width along the longitudinal length takes into account the difference in width of the user from his pelvic region to his cervical region. In a further alternative embodiment, the changes in lateral width along the longitudinal surface of the device (also referred to as transversal width) may approximate a "tear drop" shape, where the widest part of the tear drop is located at the first region 16, in order to support the pelvic region of the user's spine, and the narrowest part of the tear drop is at the second region 18, in order to support the cervical region of the user's spine. An example of a varying shape of the support device 10 is further described below.

Also, in any of the above described embodiments, the rear surface 12 may also be laterally curved, such that the user can roll the device on the ground surface from left to right as well as forward and backward.

In use, a user will place the device 10 on its rear surface 12 on a hard ground surface. The user will then lay upon the support surface 14 of the device 10, such that their pelvic/lumbar region is approximately on the first region 16, their thoracic region is approximately on the third region 20 and their cervical region is approximately on the second region 18. The weight of the user on the device 10 is such that the rear surface 12 will tend towards a flatter shape, increasing the radius of curvature of the rear surface 12. The ratio of the surface "in use" larger radius to the radius of the join surface 28 approximates the golden ratio. Also, the ratio of the "in use" straight line distance between ends 21*a* and 21*d* of the device 10 and the fourth straight line distance is a Fibonacci ratio approximating the golden ratio.

Since the curvature along the back support surface 14 of the device 10 approximates that of the curvature of a normal human spine, lying on the device 10 has the effect of supporting the spine in a normal position and proving slight tension along the spine, where the connections between at least some, or all, adjacent pairs of the user's vertebrae are held in tension, reversing the compressive effect on the spine from being in an upright position. The inventor has found that this aspect of use of the device 10 can provide relaxing and therapeutic benefit to the user's spine. Also, the device 10 can be used as a tool to help users whose spines do not follow what is considered to be a normal curvature to attain such a curvature to help improve their posture.

As will be understood, alternative embodiments of the device 10 may take on slightly different forms for different uses. For example, the device 10 of the above described embodiments may be altered such that the rear surface 12 is planar, making it easier for the device to be used as a back support for a user in a sitting position on a seat such as a chair or automobile seat. The same alternative device could also be used on a firm ground surface in a similar manner to the above described embodiments. Examples of the device being applied to various seating elements is further described below.

Figure 8:
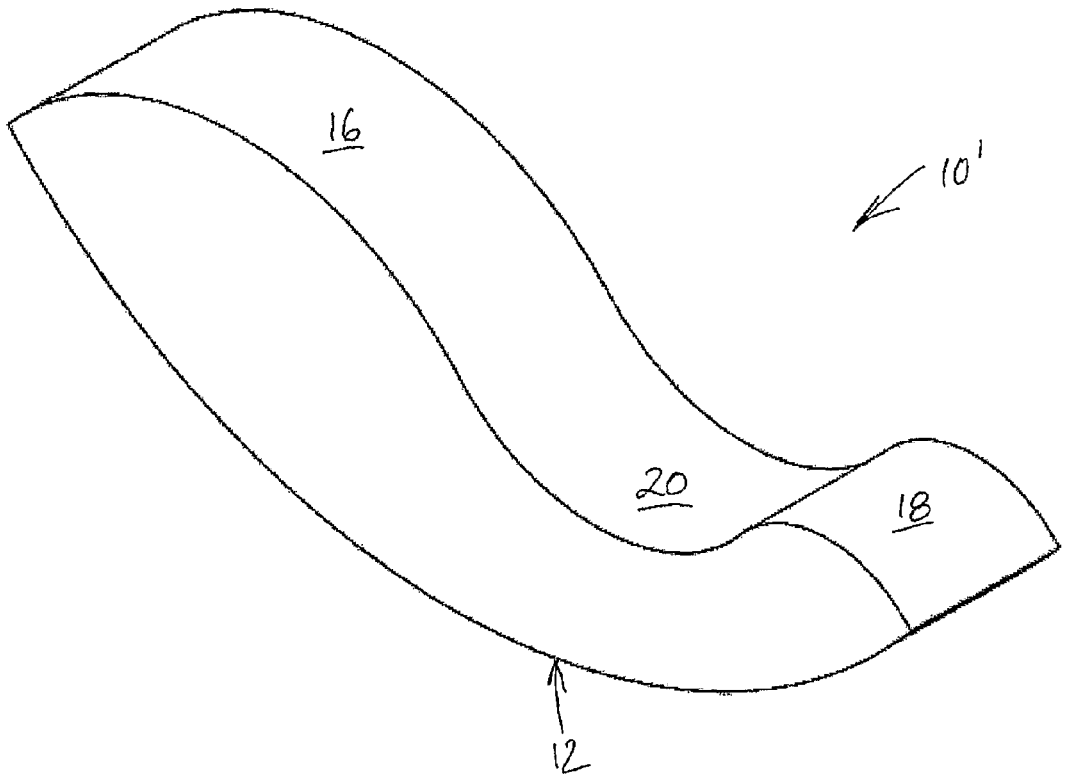
FIG. 8 illustrates a perspective view of another example of the back support device.

In an alternative embodiment, illustrated in FIG. 8 where like reference numerals denote like parts, the device 10' is made in one piece and made available in more than one length, and preferably three different lengths to accommodate different lengths of the adult spine. It is known that the length of a majority of adult human spines fall within the range of 55 to 63 cm. The lengths of the device are chosen to reflect this range. In this embodiment, the device may be stamp-cut from a piece of ethylene vinyl acetate (EVA).

In another alternative embodiment, the curves of any one, some, or all of the first, second and third regions 16,118, 20 and of the joining surface 28 and rear surface 12 may not be arcuate in the sense of tracing part of an arc of a circle; they may instead be curved but flatter, approximating the curvature of an oval-shape or similar curvature. In this alternative embodiment, the device is configured such that the above mentioned ratios between the first, second, third, fourth and "in use" straight line distances are still Fibonacci ratios approximating the golden ratio.

Further Examples

Notably, in the examples which follow like reference numerals denote like parts of the examples above, multiplied by 10.

FIGS. 9A to 9G show another example of the back support device 100 having regions for support respective regions of a user's spine. Accordingly, FIGS. 9A to 9G show the device 100 having a first support region 160 for supporting the lumbar region of a user's spine, a second supporting region 180 for supporting the cervical region of a user's spine, and a third supporting region 200 for supporting the thoracic region of a user's spine.

Figure 9A:
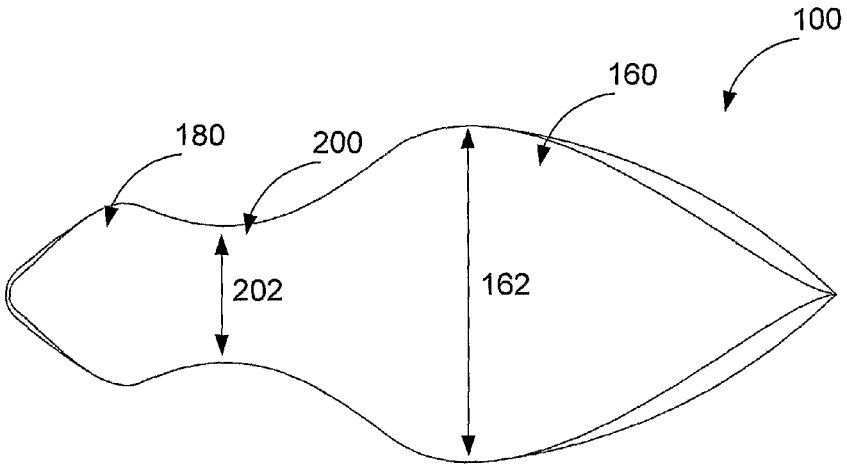
FIG. 9A illustrates a plan view of further example of the back support device.
Figure 9B:
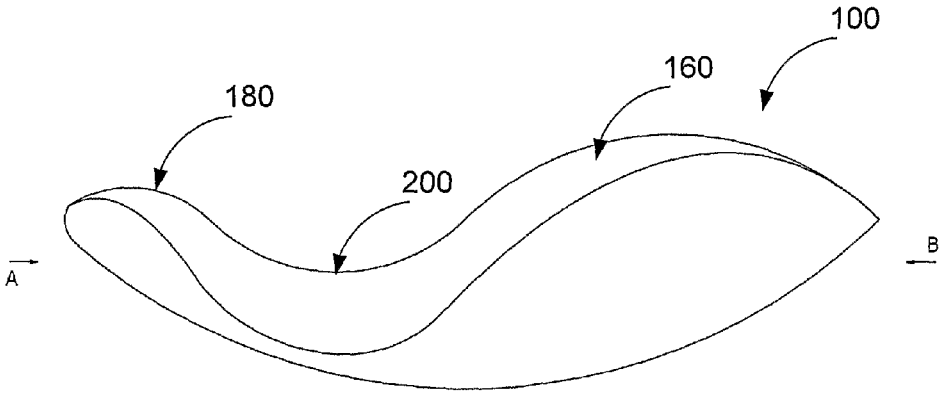
FIG. 9B illustrates a side elevation of the example device of FIG. 9A.
Figure 9C:
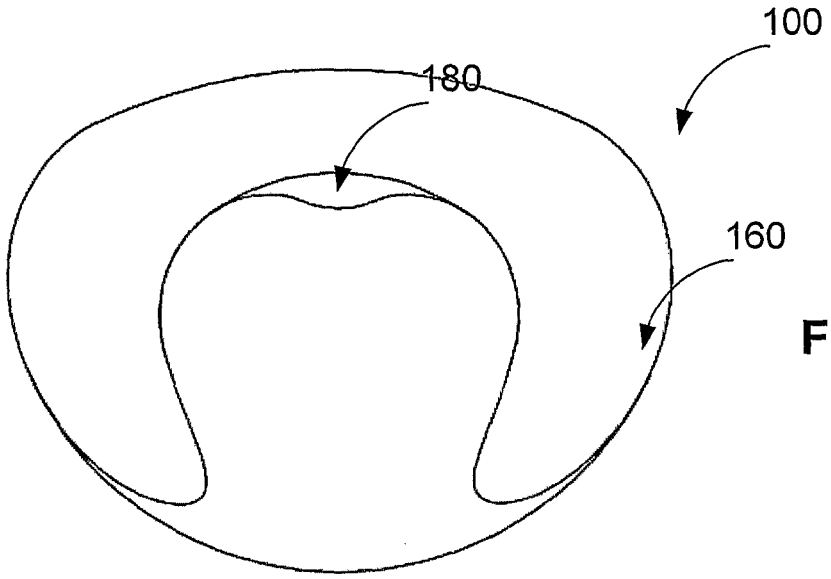
FIG. 9C illustrates an end view from viewpoint A of the example device of FIG. 9B.
Figure 9D:
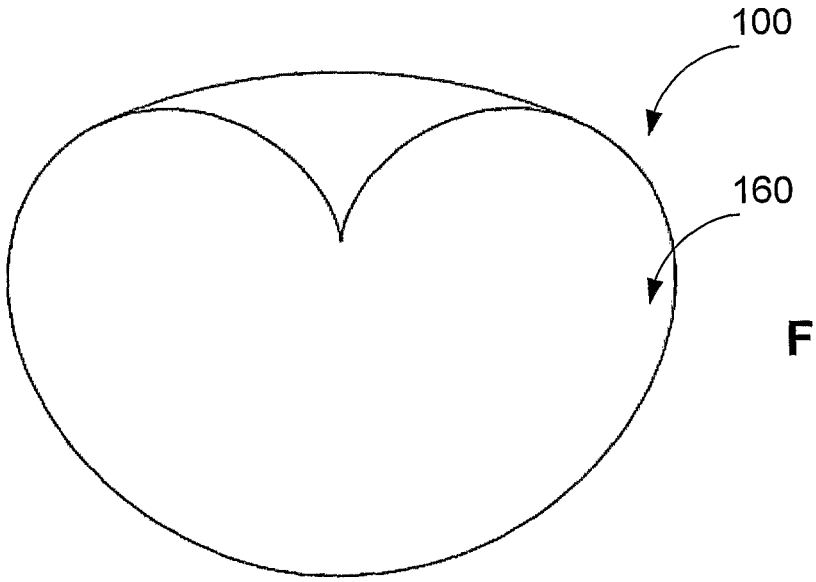
FIG. 9D illustrates an end view from viewpoint B of the example device of FIG. 9B.
Figure 9E:
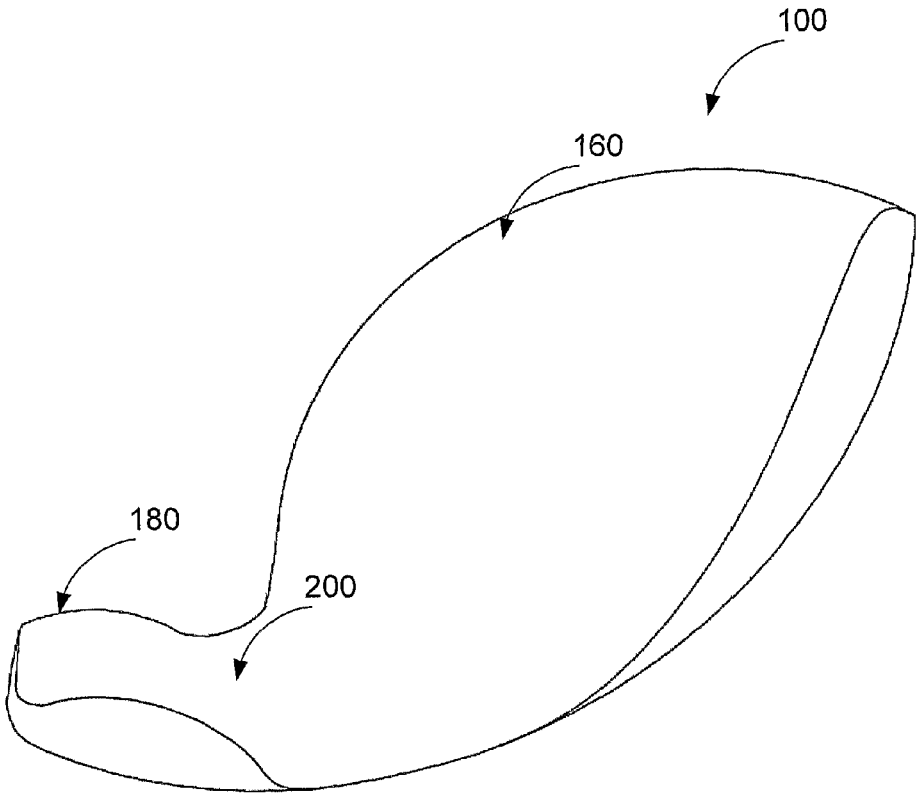
FIG. 9E illustrates a top isometric view of the example device of FIG. 9A.
Figure 9F:
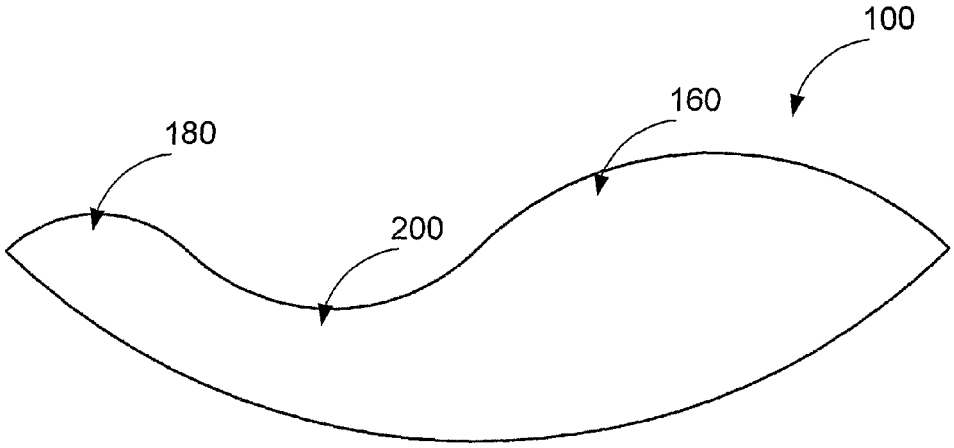
FIG. 9F illustrates a side view of the example device of FIG. 9A.

In this particular example, as can be seen in FIG. 9A, the device 100 has been formed with varying transversal width. That is, the width across the region 160 (as indicated by 162) is substantially greater than the width across the region 200 (as indicated by 202). It will be appreciated that the greater width 162 can provide greater support for the pelvic/lumbar region of a user's body, which is typically greater in transversal width than the user's neck. Accordingly, the narrower portion of the device 202 can allow for the region 200 to sit between a user's shoulder blades in the user's thoracic region.

Thus, it will be appreciated by persons skilled in the art that the device 100 can be formed of varying transversal width to support varying body types and therapeutic needs.

Figure 9G:
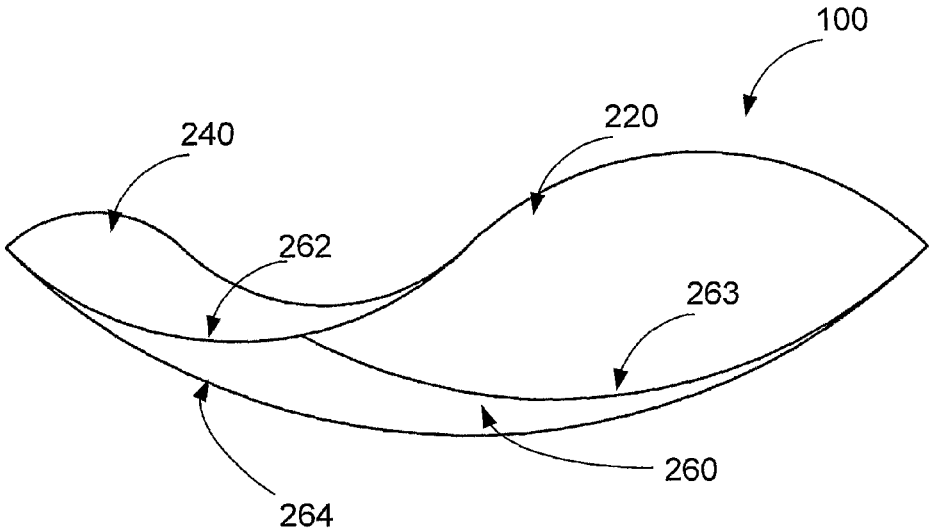
FIG. 9G illustrates a side view of another example device, showing the device including three segments.

In a further example, it will be appreciated that the back support device 100 can be formed as a device comprising of one whole segment (as shown in the side view of FIG. 9F), or alternatively, a plurality of segments being operatively connected together (as shown in FIG. 9G).

Figure 10A:
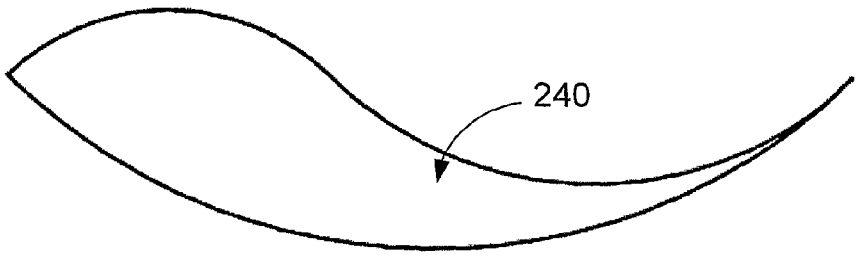
FIGS. 10A to 10C illustrate side elevations of segments which can be combined to form the example device of FIG. 9G.
Figure 10B:
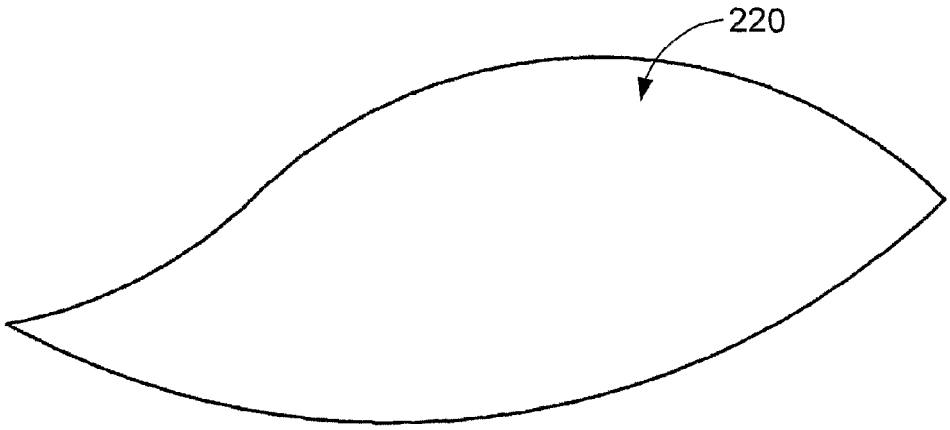
Figure 10C:
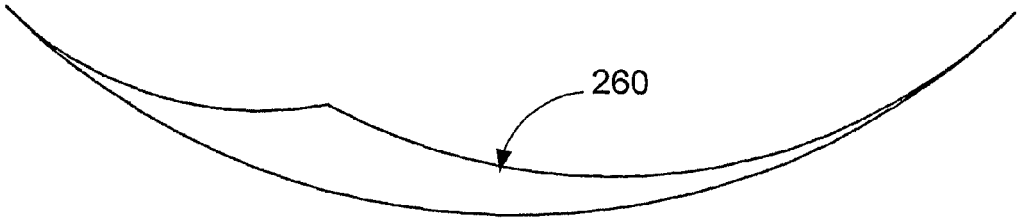

In particular, FIG. 9G shows an example of the support device 100 being formed of three segments 220, 240, and 260. In this example, segment 220 is formed to support the lumbar region of a user's spine, whereas segment 240 is formed to support the thoracic and cervical regions of a user's spine. The segments 220, 240, and 260 are shown separately in FIGS. 10A, 10B, and 10C respectively.

It will be appreciated that segment 260 has a concave acute sliding surface 262, a concave supporting surface 263 and a curved rear surface 264. In this particular example, the sliding surface 262 has a diameter substantially similar to the diameter of the first convex region 160. Furthermore, the third segment 260 of the device has a curved rear surface 264, the curved rear surface 264, the concave sliding surface 262, and the concave supporting surface 263 being portions of respective circles having radii, the ratio between the radii of the respective circles approximating to the geometric progression. Additionally, it will be appreciated that the ratio between the straight line distance across the curved rear surface, the concave supporting surface, and the concave sliding surface can also approximate to the geometric progression.

Figure 9H:
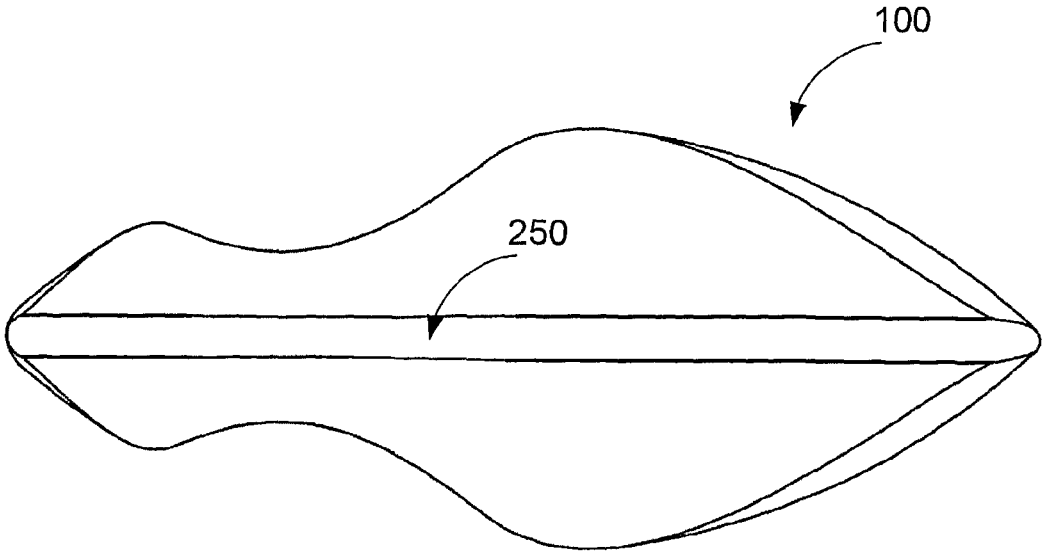
FIG. 9H illustrates a plan view of the example device of FIG. 9A, including a channel.
Figure 9I:
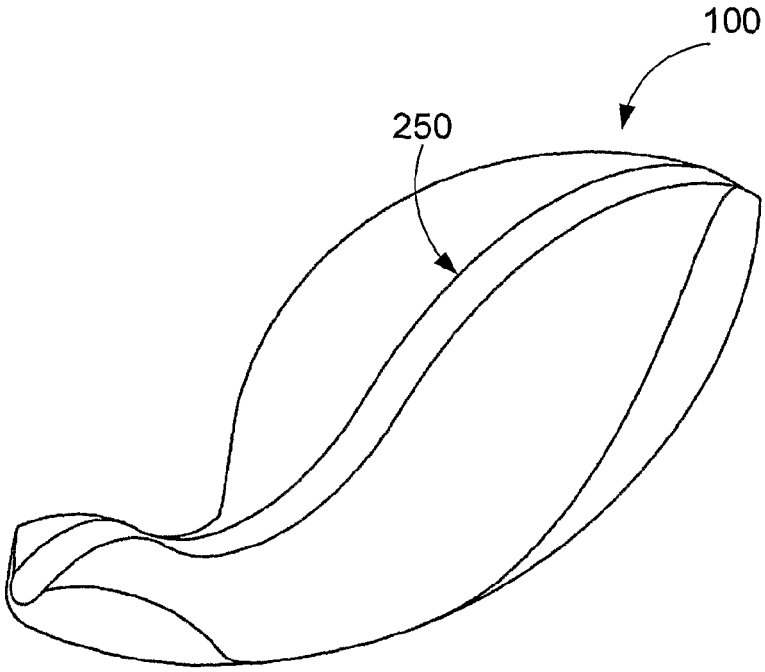
FIG. 9*illustrates* a top isometric view of the example device of FIG. 9H.

FIGS. 9H and 9I show an example of a back support device 100 including a channel 250. In one particular example, the channel can run along a longitudinal centre line, where a user's spinous process' can lie into, in order to aid spinal alignment. Additionally, the edges of the channel can also be raised to allow for the rolling of the user's erector muscles away from the spinous process' in order to aid relief. Furthermore, the channel may also be used to lock the cervical and lumbar segments of the device together.

Figure 11A:
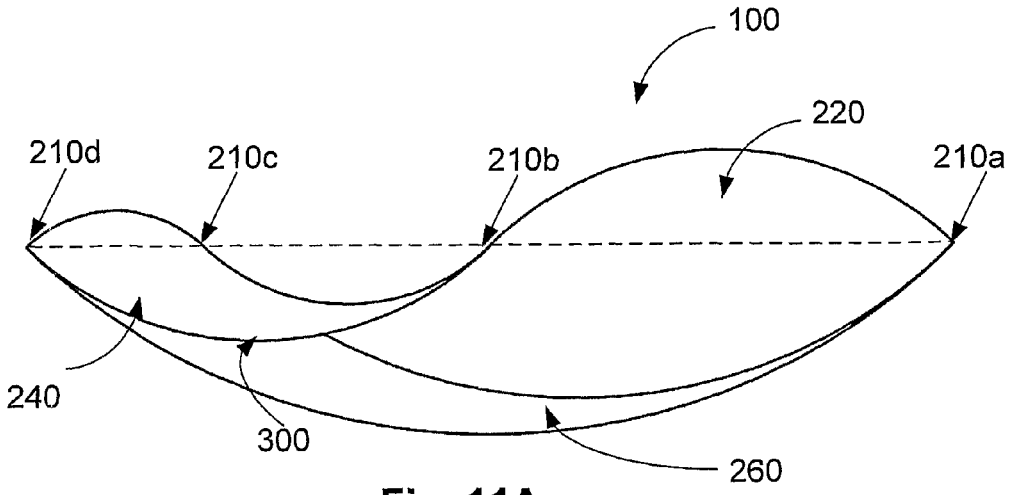
FIG. 11A illustrates a side elevation of another example of the back support device.
Figure 11B:
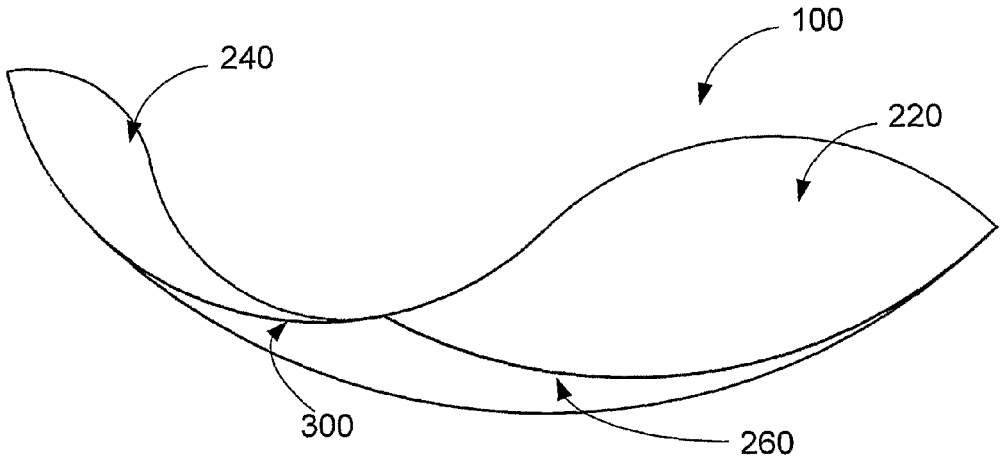
FIG. 11B illustrates a side elevation of the example device of FIG. 11A, with the one of the segments being moved slidably upon another segment.
Figure 11C:
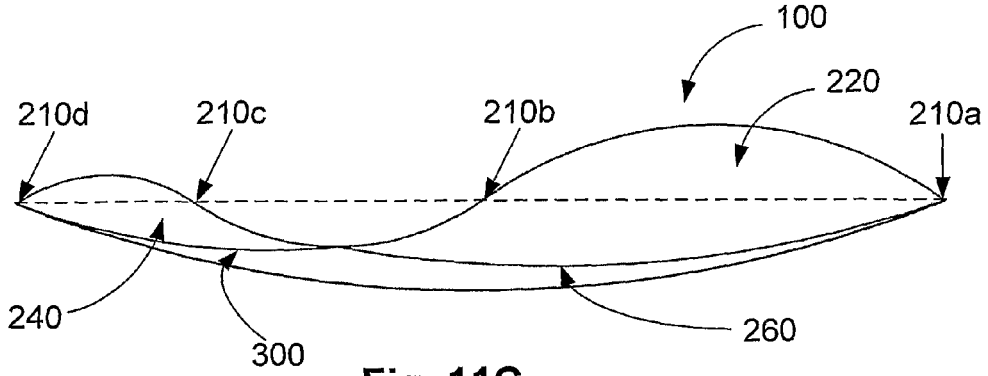
FIG. 11C illustrates a side elevation of the example device of FIG. 11B being deformed, in use.

As described above, the device 100 can be formed such that it is suitable for use by users having different spinal lengths. FIGS. 11A to 11C show an example of the device in use such that the device is adaptable for varying spinal lengths.

In particular, FIG. 11A shows the device 100 in a first form where the straight line distances between intersecting points 210*a* to 210*d* conform approximately to the golden ratio (as described above). In this example, the first 220 and the second segment 240 are connected to the third segment 260 such that the second segment 240 is movable/slidable along the connecting surface 300 of the third segment 260.

Thus, as shown in FIG. 11B, for a user with a longer spinal length, the second segment 240 can be moved such that the overall length of the device 100 is increased. In this example, as shown in FIG. 11C, the device is resiliently deformable such that, in use, the straightline distances between intersecting points 210*a* to 210*d* conform approximately to the golden ratio, and the therapeutic benefit of the device may still be achieved. Accordingly, the device 100 is able to function in deformed states in use, and is able to return to its original state (shape and design) when not in use.

Geometric Examples

As described above, the back support device of the present application can provide numerous advantages in relation to supporting a user's back. These advantages can be derived by the particular formulation of the back support device, and in one example, the structural property of having the ratio of the distances between convex and concave portions of the device approximately approaching the golden ratio. FIGS. 12 to 16 provide examples of the geometric construction of the back support device which has this structural property.

Figure 12:
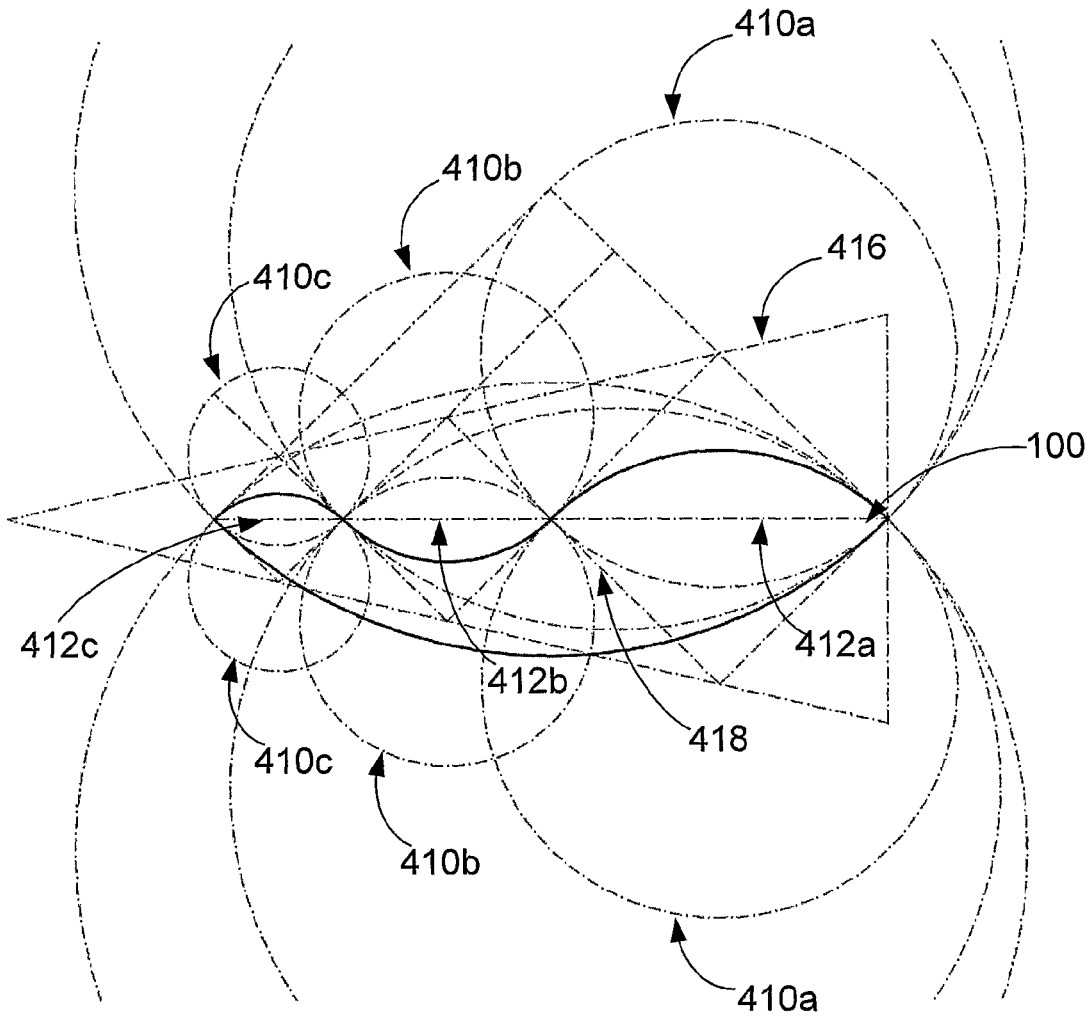
FIGS. 12 to 13D illustrate an example geometric construction of the back support device.

For example, FIG. 12 shows the device 100 being formed as though it has been made from the intersection of spheres 410*a* to 410*c*. In this example, the spheres 410*a* to 410*c* have decreasing radii in the ratio of the golden ratio. Additionally, the intersecting chords of the spheres 410*a* to 410*c* (referenced as 412*a* to 412*c* respectively) also decrease by the golden ratio. Furthermore, the lines intersecting the ipsilateral centre points of the spheres create a triangle 416 and the lines connecting the contralateral centre points of the spheres are at 90 degrees to each other.

Figure 13A:
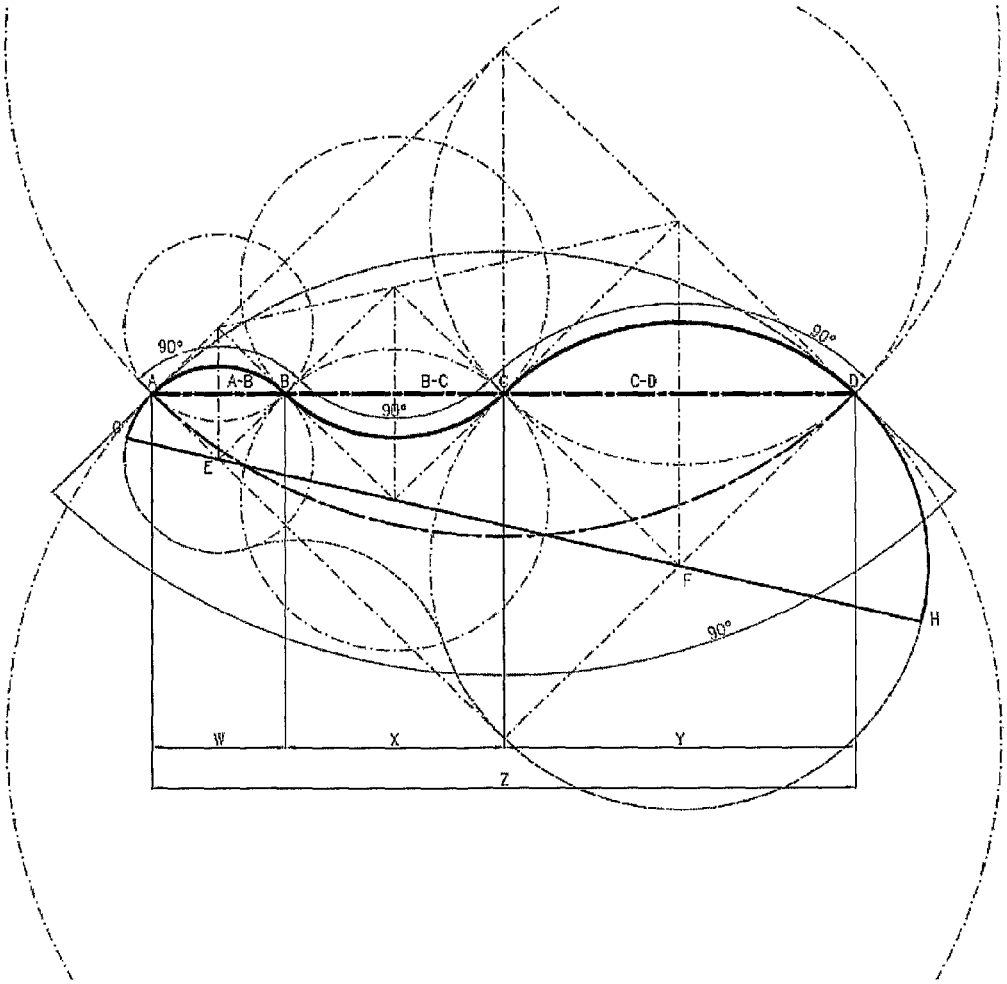
Figure 13B:
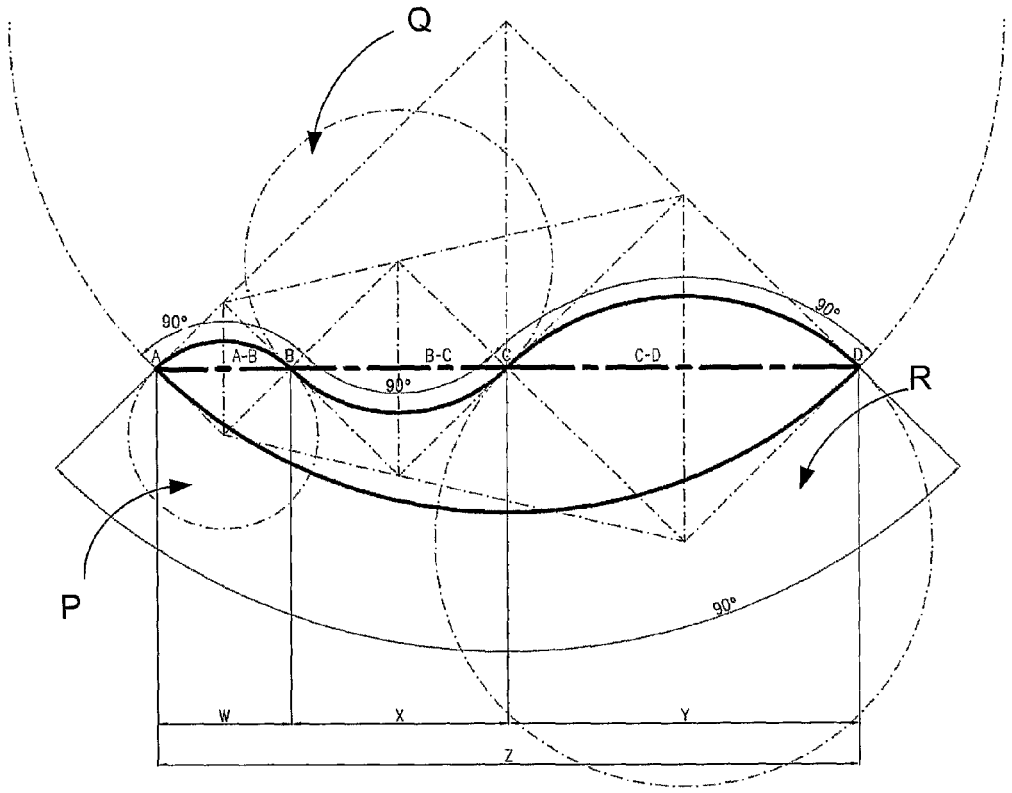

FIGS. 13A to 13D show an example of the base construction of the shape of the support device being a chain of 2-dimensional arcs along a centreline. The example of FIGS. 13A to 13D show:

- each arc being tangential to the preceding arc
- each arc segment being 90 degrees
- the centreline acting as a chord for each arc segment
- the chords of the arcs being collinear
- the ends of connecting chords being coincident
- each cord length increasing or decreasing by Phi over the previous cord length
- the profile of the device comprising of 3 arcs with the chords of each along a common centreline
- the chord of the first arc A-B being denoted by W in length
- the chord of the second arc B-C being denoted by X in length, where X is W*Phi
- the chord of the third arc C-D being denoted by Y in length, where Y is X*Phi
- the combined length of the 3 chords A-D being Z in length, where Z is equivalent to W+X+Y
- the line A-D being a chord for a 90 degree arc, where the centre of the arc is on the same side as the centre of the arc B-C Notably, FIG. 13B also shows that the radii of the spheres P, Q, and R increase by Phi, and that the line between the centre points of spheres P and Q and of Q and R are at 90 degrees or at right angles to each other.

Figure 13C:
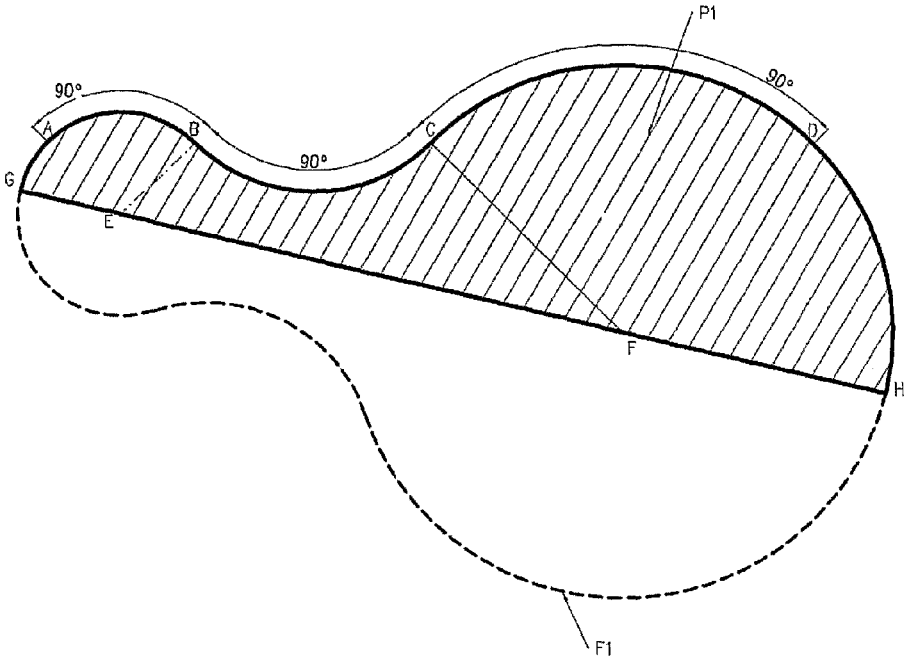
Figure 13D:
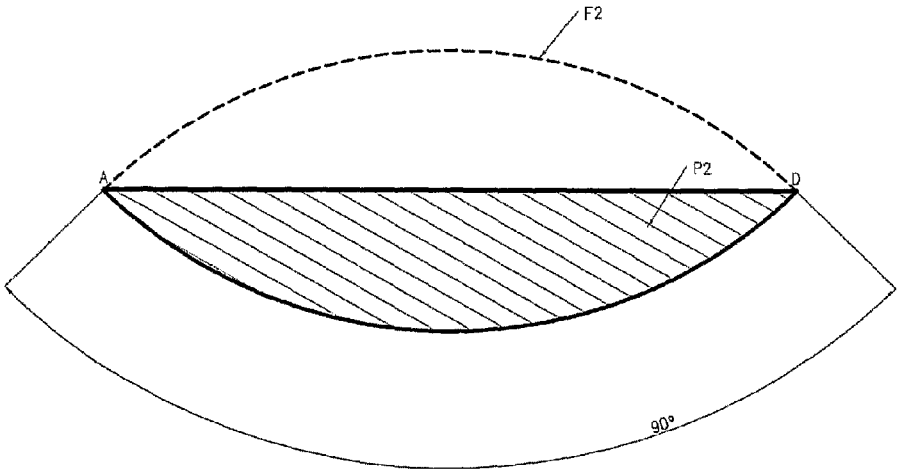

FIGS. 13C to 13D, in particular, show the 3-dimensional back support device can be constructed via:

- a centreline E-F being extended through and being coincident to the centre of the arc A-B and the centre of the arc C-D, where the arc A-B is extended from the point A until it intersects the line E-F at point G
- arc C-D being extended from point D until it intersects line E-F at the point H
- the profile or region P1 of 3 tangential arcs intersecting a straight line E-F being now closed
- the profile P1 being revolved through 360 degrees around line G-H to form a 3-dimensional form F1
- a profile P2 being formed by arc A-D and its closing chord A-D
- the profile P2 being revolved through 360 degrees to form a 3-dimensional form F2, where the 3-dimensional form created by the interference of F1 and F2 is form F3, F3 being the basic structure of the back support device As described above, the back support device can be or form a part of any object which can be used for sitting, resting, or lying upon, including but not limited to chairs, sofas, seats, beds, lounges, or the like.

Figure 14:
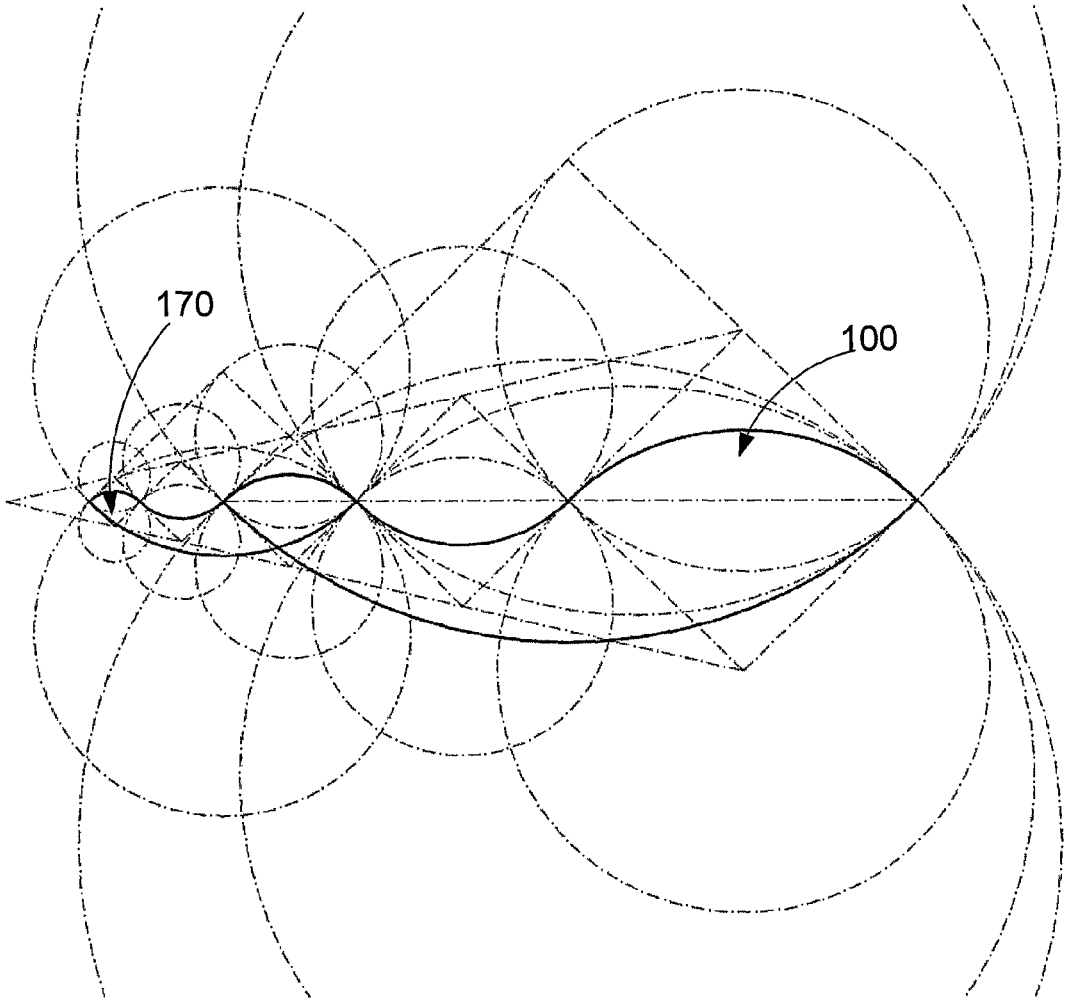
FIG. 14 illustrates an example geometric construction of the back support device with a head support portion.

Accordingly, the back support device 100 can also include a head support portion 170, as shown in FIG. 14. FIG. 14 also shows that the particular geometrical construction, as described above, can continue in order to create smaller spheres and in turn, smaller arcs all to the ratio of Phi, in order to create the heard support portion 170.

Figure 15A:
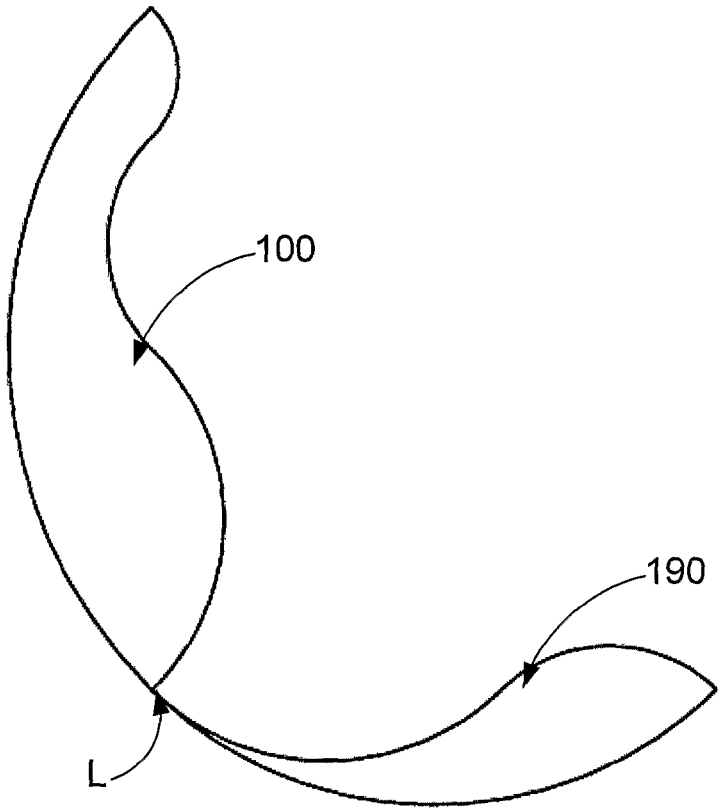
FIG. 15A illustrates a side view of another example of a back support device including a seat portion.
Figure 15B:
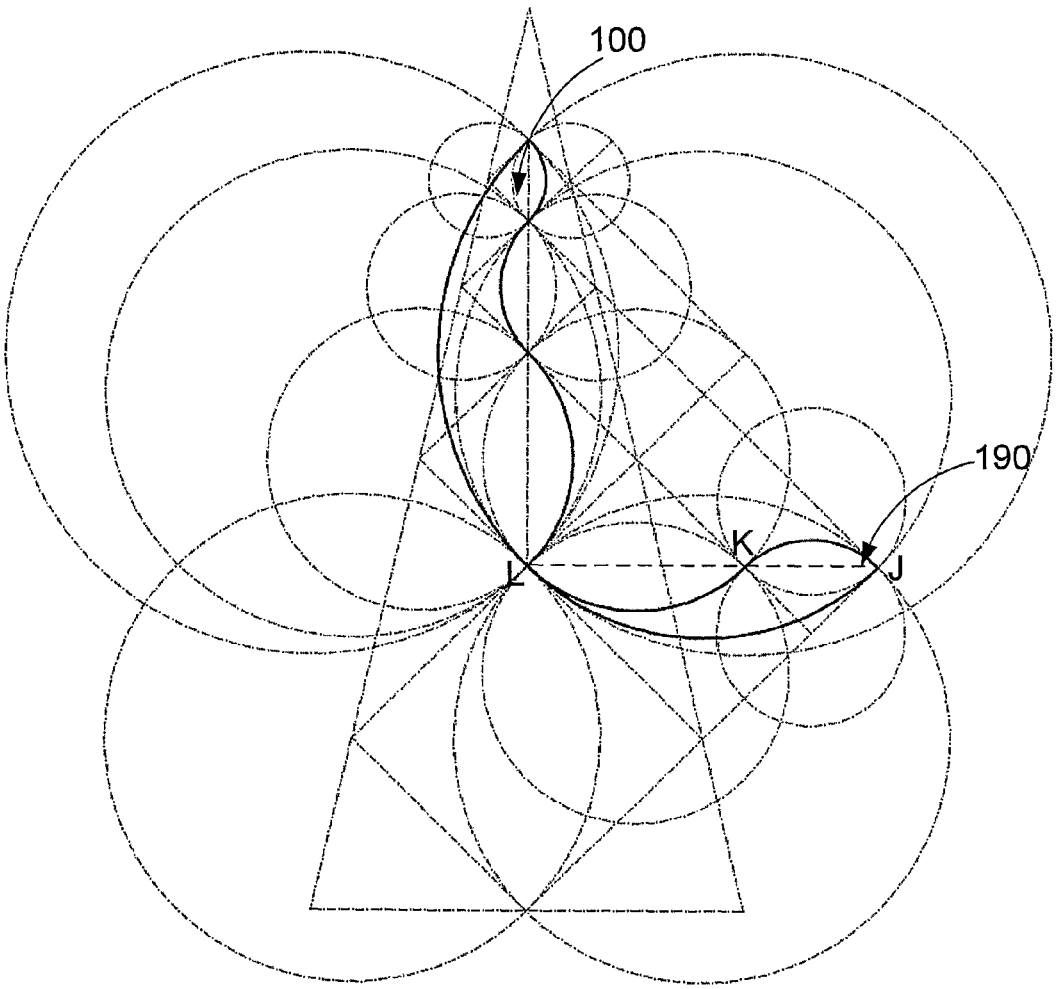
FIG. 15B illustrates an example geometric construction of the back support device of FIG. 15A.
Figure 15C:
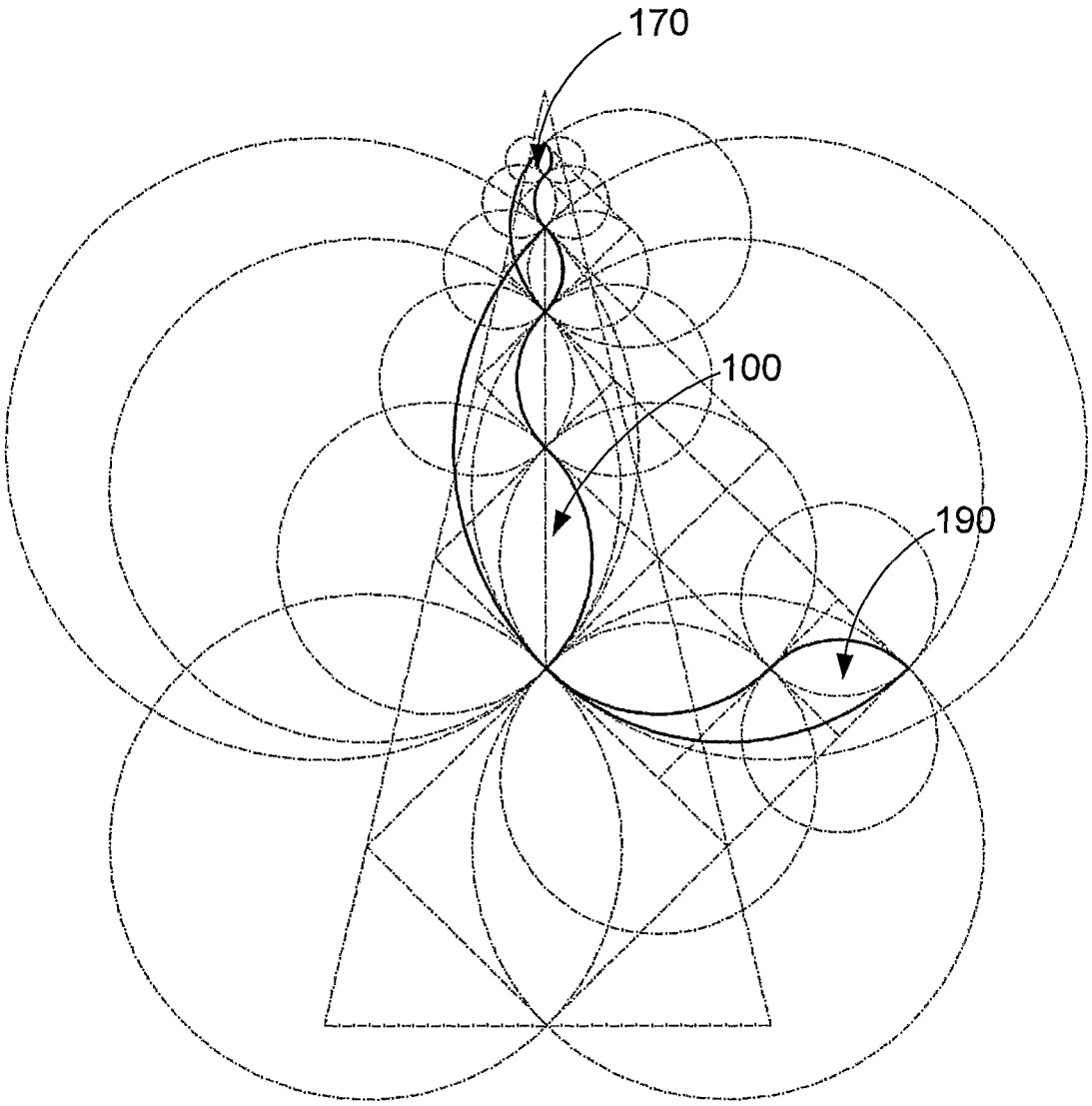
FIG. 15C illustrates an example geometric construction of the back support device of FIG. 15A, with a head support portion; and, FIG. 16 illustrates a side view of another example back support device, the back support device including a seat portion, and being formed as part of a chair.

In yet a further example, FIGS. 15A to 15C show the back support device 100 being extended to include a seat portion 190. Notably, in this example, the seat portion 190 and the back support device 100 are able to articulate to each other at any angle at the point L. FIG. 15B shows that the spheres and arcs used to construct the device 100 can continue to increase in ratios of Phi along a central chord in order to create the seat portion 190. Thus, in this example, the chord L-K is approximately equivalent to K-J*Phi. Furthermore, the chord L-J is also equivalent to L-K*Phi.

Furthermore, in one particular example, the seat portion 190 is able to fold towards the back support device 100 in order to create a vesica pisces shape, which can be spatially economically and thus may be suitable for use as public seating in locations such as cinemas, stadiums, buses, etc.

FIG. 15C shows another example of the back support device 100 including a head support portion 170.

Figure 16:
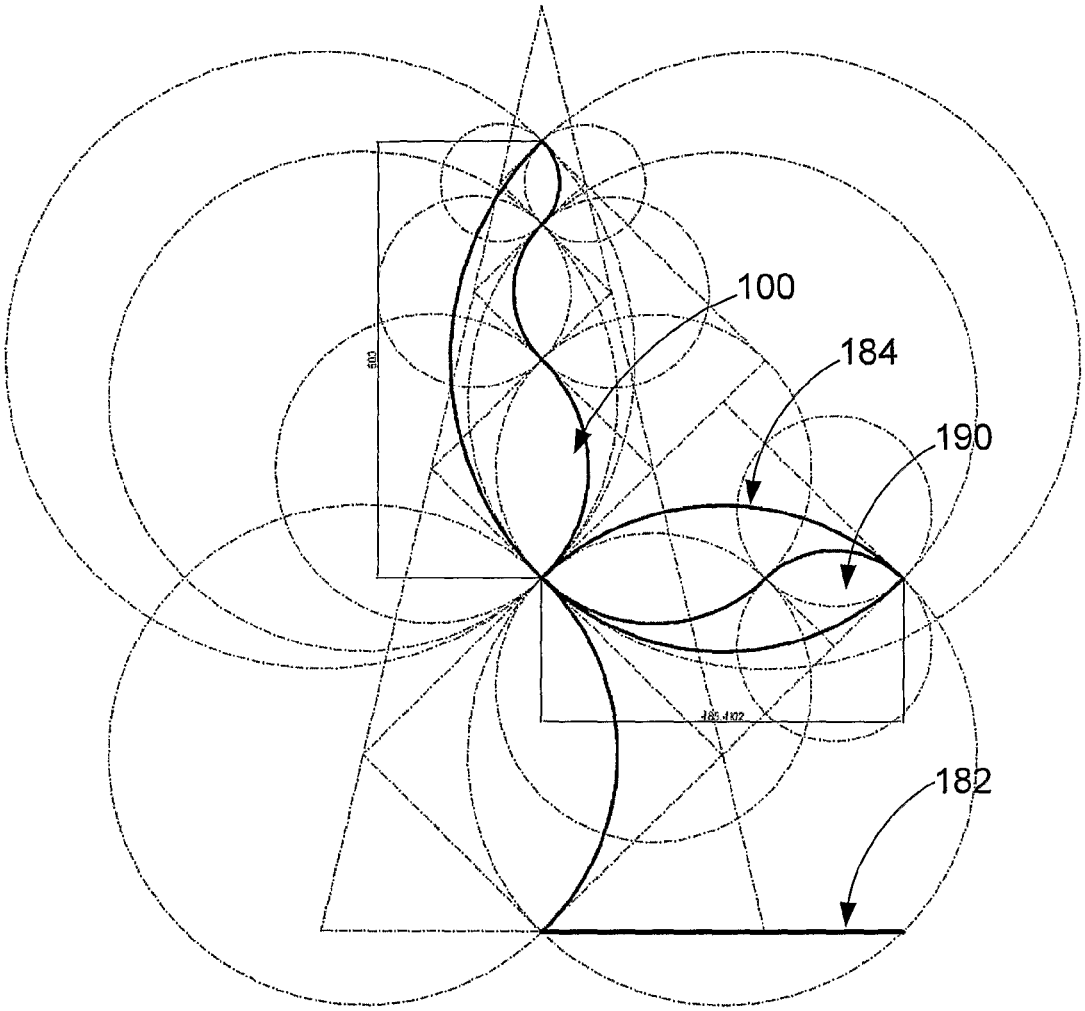

FIG. 16 shows the back support device 100 including a seat portion 190, where the back support device 100 and the seat portion 190 form a part of a chair. The chair has a base portion 182 and armrests 184.

It will also be appreciated that the above-described back support device may be formed from varying materials such as, for example, rigid materials (for example, wood, ply, fibreglass, etc.), and more dynamic materials (for example, memory foams, latex, silicon, inflatable bladders and soft filled fabrics).

It will further be appreciated that a support device can be formed from a combination of materials where the segments of the support device can be formed from varying materials in accordance with a user's therapeutic needs. Thus, for example, each separate component of the device can be manufactured of different density materials.

Thus, if foam is used, for example, the base (referred to as the third segment 26, 260) can be manufactured from a high density foam to increase the resistance of flexion for larger or heavier people. Additionally, the cervical (24, 240) and lumbar (22, 220) components can be manufactured in varying density foams for different structural conditions. Accordingly, if a user has an extreme lumbar lordosis, a lighter density foam can be used in the lumbar component while using a denser foam in the cervical component to compensate for this condition. In yet another example, for patients with thoracic kyphosis, a lighter density foam can be used in the cervical component to drop the upper thoracic and cervical spine posterior relative to the lumbar.

Furthermore, portions of the support device may be configured such that they can be manipulated by heating means, electric stimulation infra red light, or the like, or be vibrateable for aiding in muscular relief or providing a massaging function.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

While the invention has been described in reference to its preferred embodiments, it is to be understood that the words which have been used are words of description rather than limitation and that changes may be made to the invention without departing from its scope as defined by the appended claims.

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

The claims defining the invention are as follows:

1. A back support device having a first convex region a second convex region, and a concave region being connected to and between the first and second convex regions, the first and second convex regions and the concave region being configured to support respective regions of a user's back, wherein a first straight line distance across two points on the first convex region defines a first line segment having a first length, a second straight line distance across two points on the concave region defines a second line segment having a second length longer than the first length, and a third straight line distance across two points on the second convex region defines a third length longer than the second length, wherein the second straight line segment extends continuously with and in alignment with the first straight line segment, and the third straight line segment extends continuously with and in alignment with the second straight line segment, and wherein a first ratio is defined by the second length over the first length, a second ratio is defined by the third length over the second length, and the first and second ratios approximate a geometric progression.

2. The back support device of claim 1, wherein the concave region is formed between the first convex region and the second convex region.

3. The back support device of claim 2, wherein an underside of the device has a curved rear surface.

4. The back support device of claim 2, wherein the first convex region, the second convex region, and the concave region are portions of respective circles having radii, the ratio between the radii of the respective circles approximate to the geometric progression.

5. The back support device of claim 2, wherein the first convex region is configured to support a portion of a lumbar region of the user's back, the second convex region is configured to support a portion of a cervical region of the user's back, and the concave region is configured to support a portion of a thoracic region of a user's back.

6. The back support device of claim 1, wherein the device has a curved rear surface, such that the device is movable in a rocking motion on a ground surface.

7. The back support device of claim 6, wherein the curved rear surface creates an unstable surface that requires the user to stabilize themselves on the device, the stabilization activating the user's core stabilizing muscles.

8. The back support device of claim 1, wherein the device is resiliently deformable.

9. The back support device of claim 1, wherein the first convex region and the concave region form a support surface, the support surface being at least one of:

at least partially laterally flat;

at least partially laterally convex; and at least partially laterally concave.

10. The back support device of claim 9, wherein a lateral edge of the support surface is rounded.

11. The back support device of claim 1, wherein the device has varying transversal width along the device.

12. The back support device of claim 11, wherein a narrowest portion of the device is configured to sit between the user's shoulder blades along a portion of the user's thoracic region.

13. The back support device of claim 1, wherein the device includes at least one of a head support portion a seat portion, and wherein the at least one of the head support portion and the seat portion are formed such that ratio between the straight line distance across respective curves of the at least one of the head support portion and the seat portion and the straight line distances of the first convex region and the concave region of the device approximate to the geometric progression.

14. The back support device of claim 1, wherein the device supports a user's spine such that when a predetermined pressure is applied by the device to the spine, at least some adjacent pairs of vertebra of the spine are held in tension.

15. The back support device of claim 1, wherein the device is configured to flex and extend in use.

16. The back support device of claim 1, wherein the geometric progression is a Fibonacci sequence.

17. The back support device of claim 1, wherein the geometric progression approximates to 1.6±0.1.

18. The back support device of claim 1, wherein the geometric progression approximates to 1.62±0.05.

* * * * *